US006980082B2

(12) United States Patent
Ueda et al.

(10) Patent No.: US 6,980,082 B2
(45) Date of Patent: Dec. 27, 2005

(54) VEHICULAR REMOTE LOCKING/UNLOCKING SYSTEM

(75) Inventors: Shinichi Ueda, Saitama (JP); Suguru Asakura, Saitama (JP); Shinichi Arie, Saitama (JP); Akira Kamikura, Saitama (JP); Kenichi Sawada, Saitama (JP); Kentaro Yoshimura, Saitama (JP); Kazuhiko Sueoka, Gifu (JP); Naoki Hayashi, Gifu (JP)

(73) Assignees: Honda Motor Co., Ltd., Tokyo (JP); Matsushita Electric Industrial Co., Ltd., Osaka (JP)

( * ) Notice: Subject to any disclaimer, the term of this patent is extended or adjusted under 35 U.S.C. 154(b) by 203 days.

(21) Appl. No.: 10/680,405

(22) Filed: Oct. 8, 2003

(65) Prior Publication Data

US 2004/0130462 A1 Jul. 8, 2004

(30) Foreign Application Priority Data

Oct. 8, 2002 (JP) ..... 2002-295362

(51) Int. Cl.[7] ..... G08C 19/00; B60R 25/10

(52) U.S. Cl. ..... 340/5.72; 340/5.61; 340/426.16

(58) Field of Search ..... 340/5.72, 5.61, 340/825.69, 528.72, 426.16; 307/10.1, 10.2

(56) References Cited

U.S. PATENT DOCUMENTS 5,134,392 A * 7/1992 Takeuchi et al. ..... 340/5.72
5,499,022 A * 3/1996 Boschini ..... 340/5.72
5,969,597 A * 10/1999 Weigl et al. ..... 340/5.72
6,218,932 B1 * 4/2001 Stippler ..... 340/426.16
6,744,349 B1 * 6/2004 Asakura et al. ..... 340/5.72
6,765,471 B1 * 7/2004 Baudard et al. ..... 340/5.61

FOREIGN PATENT DOCUMENTS

| | | |
|---|---|---|
| EP | 0 523 602 B1 | 7/1992 |
| EP | 0 523 602 A | 1/1993 |
| EP | 1 041 226 A | 10/2000 |
| FR | 2 814 188 A | 3/2002 |

* cited by examiner

*Primary Examiner*—Brian Zimmerman
*Assistant Examiner*—Clara Yang
(74) *Attorney, Agent, or Firm*—Arent Fox PLLC

(57) ABSTRACT

In a vehicular remote locking/unlocking system, when a locking or unlocking switch outputs a trigger signal, a second transmission device transmits identification information transmission disable signal, before a first transmission device transmits identification information request signal. When a portable device of the vehicular remote system receives the transmission disable signal, even if the portable device receives a subsequent request signal, transmission of identification information from the portable device is disabled for a predetermined period of time, thereby disabling operation of a door lock actuator. Since the second transmission device transmits a transmission disable signal a plurality of times in succession, the influence of noise is eliminated, thereby reliably preventing the portable transceiver within the vehicle from outputting an ID signal.

2 Claims, 9 Drawing Sheets

VEHICULAR REMOTE LOCKING/UNLOCKING SYSTEM

BACKGROUND OF THE INVENTION

1. Field of the Invention

The present invention relates to a vehicular remote locking/unlocking system wherein a vehicle user equipped with a portable device operates trigger means located in a vehicle and a locking/unlocking means carries out locking/unlocking of an opening member of the vehicle.

2. Description of the Related Art

European Patent No. 0523602 B1 discloses, as shown in FIG. 9, two techniques (i.e., Technique 1 and Technique 2). Technique 1 includes external antennas 2 and 3 directed toward spaces outside a vehicle and having signal transmission ranges indicated as I and II, respectively, and an internal antenna 5 directed toward a space within the vehicle and having a signal transmission range indicated as III. Technique 1 locks and unlocks doors only if a transponder 6 is present outside a passenger compartment, by sequentially transmitting interrogation code signals from the internal antenna 5 and the external antennas 2 and 3 when a start switch (a door outer handle, or a door inner handle) is operated, and sequentially evaluating a received response signal from the transponder 6 to detect the position of the transponder 6. Technique 2 prevents unauthorized unlocking of the doors if the transponder 6 is left behind in the passenger compartment, by sequentially transmitting interrogation code signals with antenna identification codes added thereto and making the transponder 6 only transmit a response signal in response to the interrogation code signals transmitted from the external antennas 2 and 3.

However, because the response signal has to be transmitted even when the transponder 6 is present within the passenger compartment, the number of communications in Technique 1 increases, thereby wasting the power of the transponder 6. There is also the problem that, when the signal transmission range of the internal antenna 5 is reduced due to interference, such as, for example, noise, if the transponder 6 is left behind in a place, such as a door pocket, which is typically positioned on the outermost side within the passenger compartment (a range where I and II overlap), since no response signal is transmitted in response to the interrogation code signal from the internal antenna 5, it is determined that the transponder 6 is present outside the passenger compartment, and a malfunction occurs.

In the case of Technique 2, when the transponder 6 is left behind in the range of III that does not overlap with I, that is, in a middle part of the passenger compartment, unauthorized locking/unlocking can be prevented. However, when the transponder 6 is left behind in a place, such as a door pocket, although the interrogation code signal from the internal antenna 5 is not acknowledged, because a response signal is transmitted to the interrogation code signal that is subsequently transmitted from the external antennas 2 and 3, unauthorized locking/unlocking cannot reliably be prevented.

It should be noted that the signal transmission range referred to here means a range in which the transponder 6 is able to receive the interrogation code signal.

SUMMARY OF THE INVENTION

The present invention has been achieved in view of the above-mentioned circumstances, and provides a vehicular remote locking/unlocking system wherein, when a portable device is left behind within a passenger compartment, unauthorized locking/unlocking of an opening member of the vehicle is reliably prevented.

In order to provide such a system, a first aspect of the present invention provides a vehicular remote locking/unlocking system including first transmission means which is located in a vehicle and which transmits to a predetermined area outside the vehicle a request signal requesting transmission of identification information. Second transmission means located in the vehicle transmits a transmission disable signal to a predetermined area within the vehicle, the transmission disabling signal disabling transmission of identification information for a predetermined period of time. A portable device carried by a vehicle user transmits identification information upon receiving the request signal. Receiving means located in the vehicle receives the identification information from the portable device. Trigger means located in the vehicle outputs a trigger signal initiating operation of the first and second transmission means, the trigger means being operated by the vehicle user. Locking/unlocking means carries out the locking/unlocking of an opening member of the vehicle when the identification information received by the receiving means matches identification information stored on the vehicle side. When the trigger means outputs the trigger signal, before the first transmission means transmits the request signal, the second transmission means transmits the transmission disable signal a plurality of times in succession so as to disable transmission of the identification information from the portable device for a predetermined period of time, thereby disabling the operation of the locking/unlocking means when the portable device is present within the vehicle.

In accordance with this arrangement, if the portable device is left behind within a passenger compartment when the trigger means is operated to operate the locking/unlocking means of the vehicle, because the portable device receives the transmission disable signal transmitted by the second transmission means and transmission of the identification information from the portable device is thus disabled, the operation of the locking/unlocking means can reliably be disabled, thereby preventing unauthorized locking/unlocking of the opening member of the vehicle. On the other hand, if the vehicle user is equipped with the portable device when the trigger means is operated to operate the locking/unlocking means of the vehicle, the portable device does not receive the transmission disable signal transmitted by the second transmission means, but the portable device receives the request signal transmitted by the first transmission means, and transmits the identification information. Therefore, it is possible to operate the locking/unlocking means to lock/unlock the opening member of the vehicle. In particular, when the portable device receives the transmission disable signal, transmission of the identification information from the portable device is disabled for the predetermined period of time. Therefore, even when the portable device is left behind in a position where the signal transmission range of the first transmission means overlaps the signal transmission range of the second transmission means, it is possible to disable transmission of the identification information from the portable device, thereby preventing unauthorized locking/unlocking of the opening member of the vehicle. Moreover, since the second transmission means transmits the transmission disable signal a plurality of times in succession, even if any one of the transmission disable signals transmitted a plurality of times in succession is inhibited by noise, the remainder of the transmission disable signals can reliably disable transmission of the identification information from the portable device within the passenger compartment, thereby enhancing the reliability of the vehicular remote locking/unlocking device. Furthermore, since the portable device transmits identification information only when located outside the passenger compartment and transmits no identification information when located within the passenger compartment, the power consumption of the portable device is substantially reduced, i.e., minimized.

Furthermore, in accordance with a second aspect of the present invention, there is provided a vehicular remote locking/unlocking system wherein when the receiving means receives from the portable device the identification information that matches the identification information stored on the vehicle side, after the second transmission means re-transmits the transmission disable signal, the first transmission means transmits a secondary request signal containing the identification information. When the portable device is not in a state in which transmission is disabled and the identification information contained in the secondary request signal received by the portable device is its own identification information, the portable device re-transmits the identification information. When the identification information received by the receiving means successively matches the identification information stored on the vehicle side, the locking/unlocking means carries out locking/unlocking of the opening member of the vehicle. In accordance with this arrangement, since the process of 'transmitting the request signal from the first transmission means' and 'receiving legitimate identification information from the portable device' is repeated twice and, in particular, in the second process the position of the portable device is confirmed by the request signal specifying the portable device having the identification information received in the first process, it is further reliably possible to confirm that the vehicle user is equipped with the portable device, thereby reliably preventing malfunction of the vehicular remote locking/unlocking device.

A portable transceiver 11 of an embodiment corresponds to the portable device of the present invention, locking switches 22L and 22R and unlocking switches 23L and 23R of the embodiment correspond to the trigger means of the present invention, a door lock actuator 27 of the embodiment corresponds to the locking/unlocking means of the present invention, first LF antennas 28L and 28R of the embodiment correspond to the first transmission means of the present invention, second LF antennas 29*f* and 29*r* of the embodiment correspond to the second transmission means of the present invention, an RF receiver 26 and an RF antenna 30 of the embodiment correspond to the receiving means of the present invention, and an ID signal and a function signal f(x) of the embodiment correspond to the identification information of the present invention.

The above-mentioned characteristics and advantages of the present invention will become apparent from an explanation of an embodiment described in detail below by reference to the attached drawings.

DESCRIPTION OF THE PREFERRED EMBODIMENT

Figure 1:
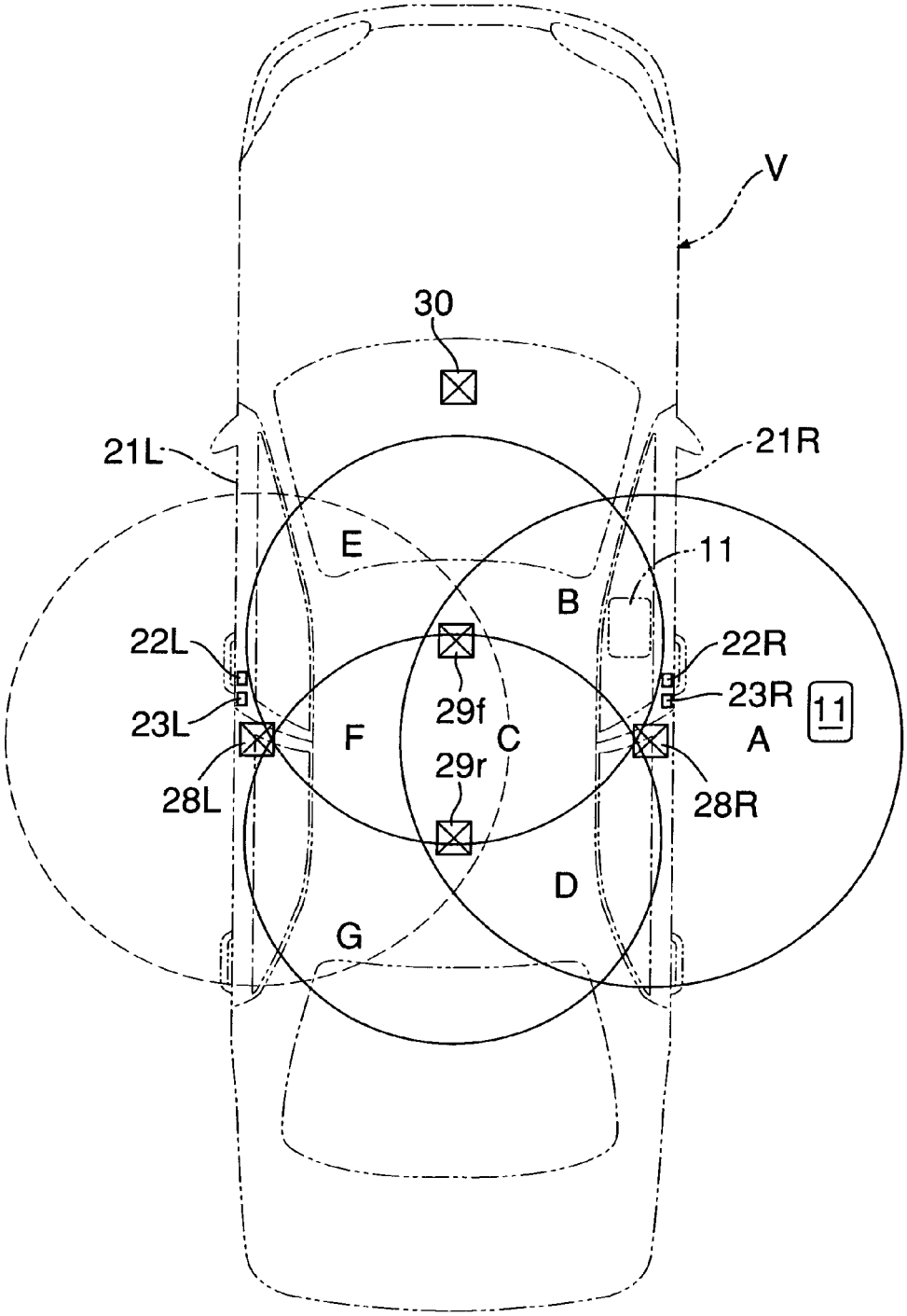
FIG. 1 is a schematic diagram showing the overall arrangement of a vehicular remote locking/unlocking system, according to an embodiment of the present invention.
Figure 2:
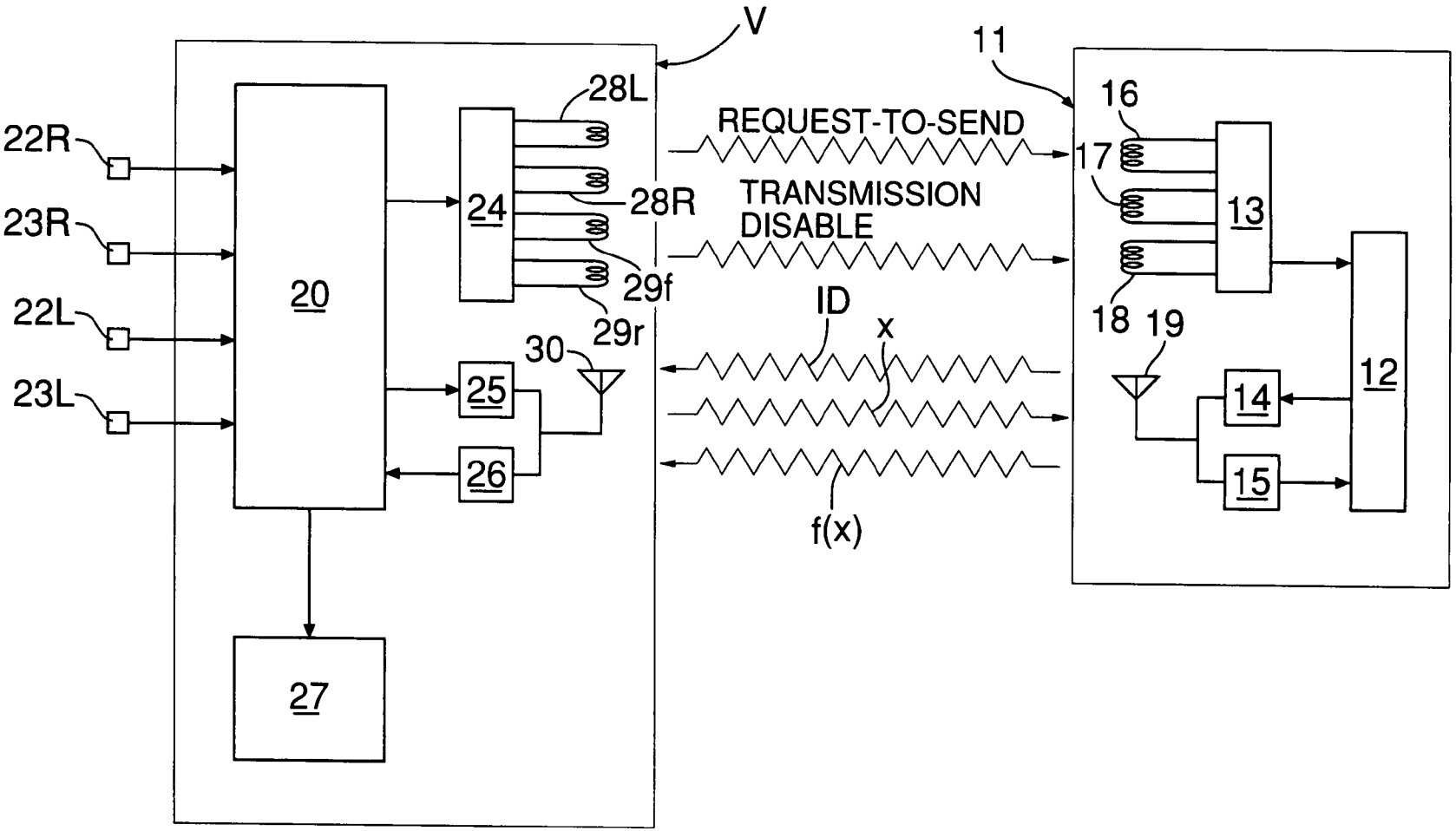
FIG. 2 is a block diagram of the vehicular remote locking/unlocking system illustrated in FIG. 1.

As shown in FIG. 1 and FIG. 2, a vehicular remote locking/unlocking system according to an embodiment of the present invention, which locks and unlocks doors of a vehicle V without using a key, includes a card-type portable transceiver 11 for a vehicle user to carry, such as, for example, in a pocket or a bag. Connected to a control unit 12 of the portable transceiver 11 are an LF (low frequency) receiver 13, an RF (radio frequency) transmitter 14, and an RF (radio frequency) receiver 15. Connected to the LF receiver 13 are three LF antennas 16, 17, and 18 having axes orthogonal to each other. A common RF antenna 19 is connected to the RF transmitter 14 and the RF receiver 15.

Connected to a control unit 20 provided on the vehicle V of the vehicle side remote system are a locking switch 22L and an unlocking switch 23L provided on a left front door 21L, a locking switch 22R and an unlocking switch 23R provided on a right front door 21R, an LF transmitter 24, an RF transmitter 25, an RF receiver 26, and a door lock actuator 27. Left and right first LF antennas 28L and 28R provided in the vicinity of the external surface of the vehicle V and front and rear second LF antennas 29*f* and 29*r* provided within a passenger compartment are connected to the LF transmitter 24. A common RF antenna 30 is connected to the RF transmitter 25 and the RF receiver 26.

First LF antenna 28L, which transmits an ID signal request-to-send signal, is provided to the rear of the left front door 21L and has a signal transmission range (shown as a circle having the left-hand first LF antenna 28L at its center). The signal transmission range of the first antenna 28L covers the position of a vehicle user standing near the left front door 21L to operate the locking switch 22L or the unlocking switch 23L. In a similar manner, the first LF antenna 28R, which transmits an ID signal request-to-send signal, is provided to the rear of the right front door 21R and has a signal transmission range, (shown as a circle having the right-hand first LF antenna 28R at its center). The signal transmission range of the first LF antenna 28R covers the position of a vehicle user standing near the right front door 21R to operate the locking switch 22R or the unlocking switch 23R.

Second LF antennas 29*f* and 29*r*, which transmit an ID signal transmission disable signal, are disposed on the center line of the vehicle body and are separated from each other in the longitudinal direction. The signal transmission ranges of the second LF antennas 29*f* and 29*r*, (shown as two circles having the second LF antennas 29*f* and 29*r* at their centers), substantially cover the whole area of the passenger compartment. The RF antenna 30 is provided at an appropriate position of the vehicle V.

The signal transmission range referred to herein is a range where the portable transceiver 11 receives a signal from the first and second LF antennas 28L, 28R, 29*f* and 29*r*.

The signal transmission range of the first LF antenna 28R and the signal transmission ranges of the second LF antennas 29*f* and 29*r* define Areas A to G. In Area A, only an ID signal request-to-send signal from the first LF antenna 28R can be received by the portable transceiver 11. In Area B, an ID signal request-to-send signal from the first LF antenna 28R and an ID signal transmission disable signal from the front second LF antenna 29*f* can be received by the portable transceiver 11. In Area C, an ID signal request-to-send signal from the first LF antenna 28R and ID signal transmission disable signals from the second LF antennas 29*f* and 29*r* can be received by the portable transceiver 11. In Area D, an ID signal request-to-send signal from the first LF antenna 28R and an ID signal transmission disable signal from the rearward located second LF antenna 29*r* can be received by the portable transceiver 11. In Area E, only an ID signal transmission disable signal from the forward located second LF antenna 29*f* can be received by the portable transceiver 11. In Area F, ID signal transmission disable signals from the second LF antennas 29*f* and 29*r* can be received by the portable transceiver 11. In Area G, only an ID signal transmission disable signal from the rearward located second LF antenna 29*r* can be received by the portable transceiver 11.

The basic operation of an embodiment of the vehicular remote system will now be explained.

When a vehicle user equipped with a legitimate portable transceiver 11 presses either the unlocking switch 23L of the left door 21L or the unlocking switch 23R of the right door 21R, an ID signal request-to-send signal is transmitted from the corresponding first LF antenna 28L or 28R on the vehicle V side. The portable transceiver 11 receives the ID signal request-to-send signal via the LF antennas 16 to 18 and then transmits an ID signal, which is stored in the control unit 12, from the RF antenna 19. The control unit 20 receives the ID signal via the RF antenna 30 on the vehicle V side and then confirms whether the ID signal is a legitimate ID signal pre-stored in the control unit 20. If the ID signal is a legitimate ID signal, the control unit 20 then transmits a random number signal $\underline{x}$ from the RF antenna 30.

The portable transceiver 11 receives the random number signal $\underline{x}$ via the RF antenna 19 and then transmits from the RF antenna 19 a function signal f(x) calculated using the random number signal $\underline{x}$ according to a program stored in the control unit 12. The control unit 20 receives the function signal f(x) via the RF antenna 30 on the vehicle V side and then compares the received function signal f(x) with a function signal f(x) calculated therein from the random number signal $\underline{x}$. If both function signals f(x) match, the control unit 20 instructs the door lock actuator 27 to operate and unlock the front doors 21L and 21R.

In a similar manner, when a vehicle user equipped with a legitimate portable transceiver 11 presses the locking switch 22L of the left door 21L or the locking switch 22R of the right door 21R, the control unit 20 instructs the door lock actuator 27 to operate and to lock the front doors 21L and 21R.

The above-mentioned operation occurs when a vehicle user equipped with the legitimate portable transceiver 11 uses either the locking switch 22L or 22R or the unlocking switch 23L or 23R. However, when the portable transceiver 11 is left behind within the passenger compartment, a person other than the vehicle user can lock and unlock the doors 21L and 21R simply by operating either the locking switch 22L or 22R or the unlocking switch 23L or 23R to instruct the door lock actuator 27 to operate, thereby facilitating unauthorized use or entry of the vehicle V. In an embodiment of the present invention, the second LF antennas 29*f* and 29*r* disposed within the passenger compartment transmit ID signal transmission disable signals, which, for a predetermined period of time, disable transmission of an ID signal from the portable transceiver 11 left behind within the vehicle and operation of the door lock actuator 27.

Figure 3:
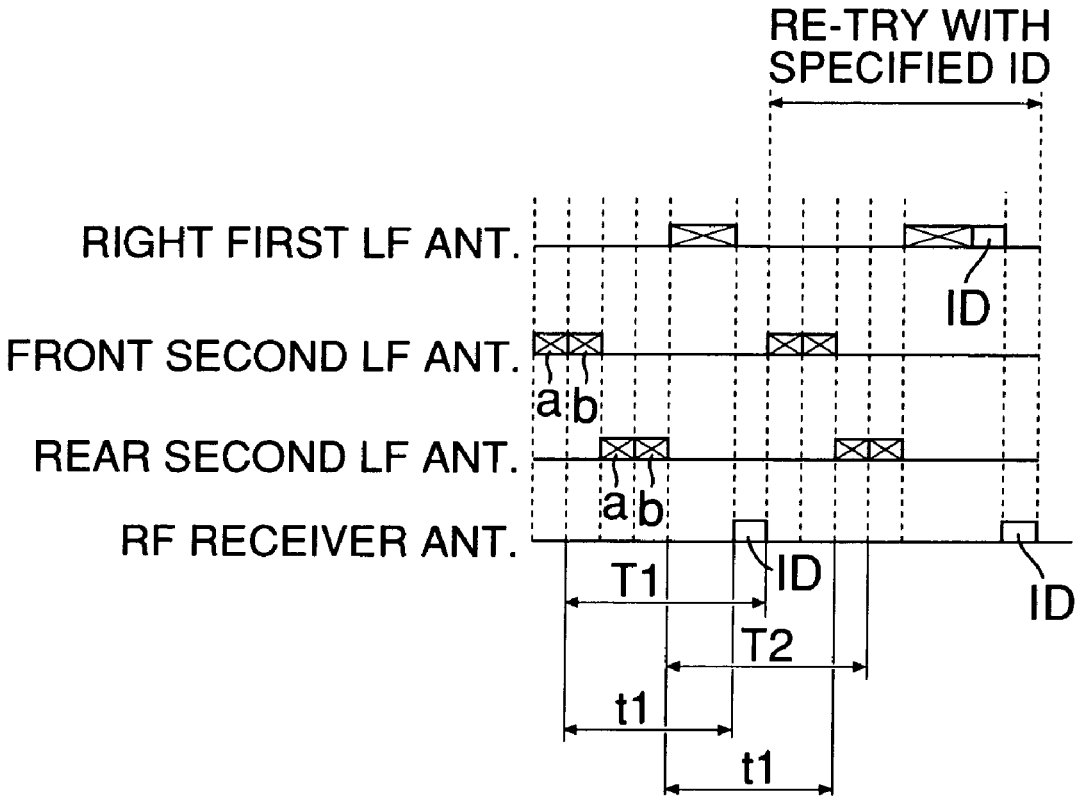
FIG. 3 is a time chart explaining operation of the vehicular remote locking/unlocking system of FIG. 1 when a vehicle user is equipped with a portable transceiver.
Figure 6:
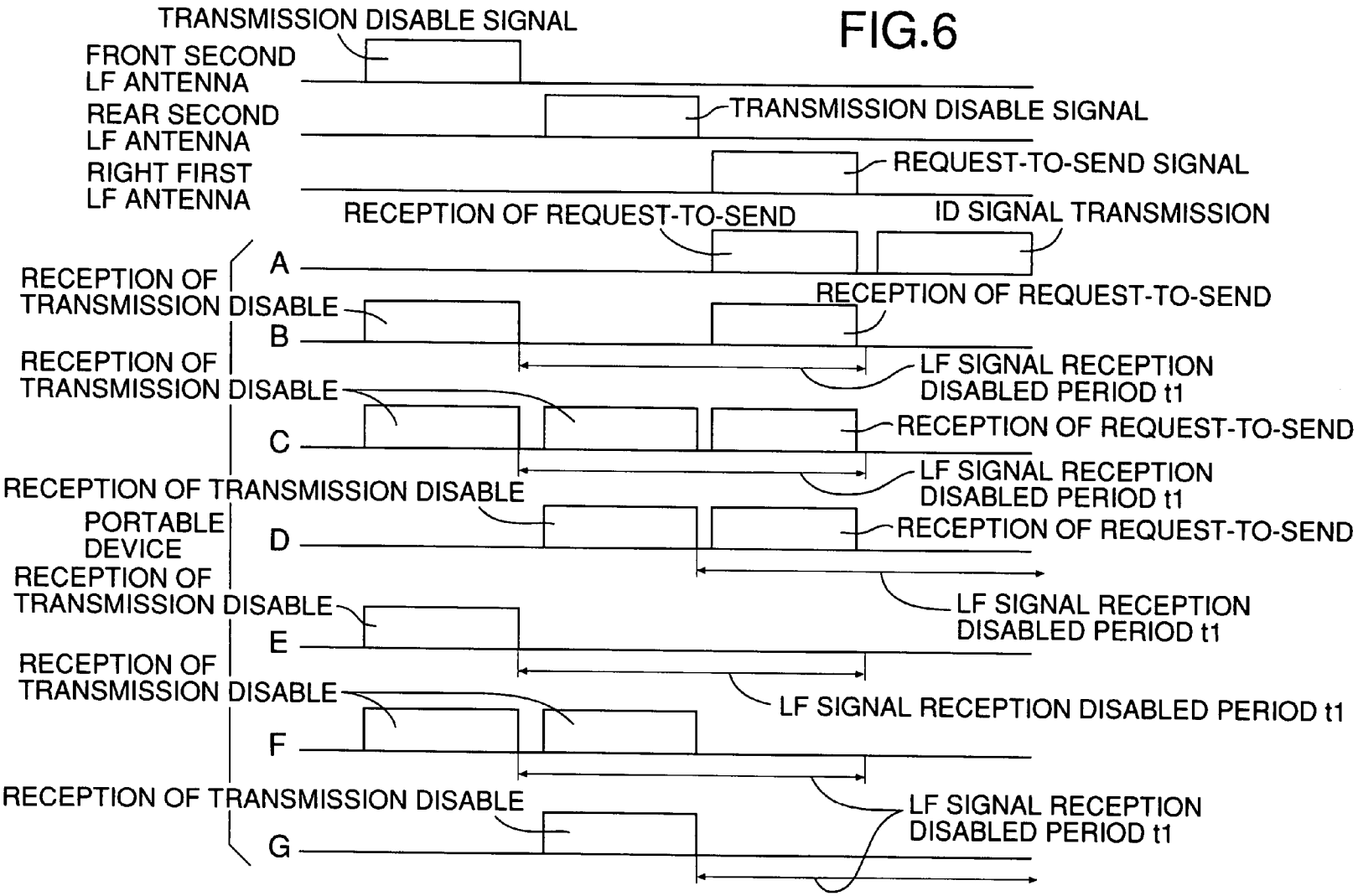
FIG. 6 is a time chart explaining operation of the vehicular remote locking/unlocking system of FIG. 1 when a portable transceiver is present in illustrated Areas A through G.

As shown in FIG. 3 and FIG. 6, for example, a trigger signal is output when the vehicle user operates the unlocking switch 23R of the right door 21R. Based on the output trigger signal, an ID signal transmission disable signal is first transmitted from the forward located second LF antenna 29*f*. An ID signal transmission disable signal is subsequently transmitted from the rearward located second LF antenna 29*r*. An ID signal request-to-send signal is subsequently transmitted from the first LF antenna 28R on the right side (on the operated unlocking switch 23R side).

During the above-described process, if the portable transceiver 11 is located in Area A, for example, the vehicle user is in possession of the portable transceiver 11, since the ID signal transmission disable signals are not received by the portable transceiver 11, the portable transceiver 11 transmits an ID signal in response to the received ID signal request-to-send signal. In contrast, if the portable transceiver 11 is located in Areas B through G, for example, when the vehicle user has left the portable transceiver 11 behind somewhere within the passenger compartment, the portable transceiver 11 does not transmit the ID signal. In other words, if the portable transceiver 11 is located in Areas B, C, or D, even though the portable transceiver 11 is able to receive the ID signal request-to-send signal, the ID signal transmission disable signal has already been received. Therefore, the ID signal will not be transmitted unless a predetermined period of time elapses after the ID signal transmission disable signal is received. If the portable transceiver 11 is located in Areas E, F, or G, the ID signal request-to-send signal is not received, so that the ID signal will be transmitted.

Figure 4:
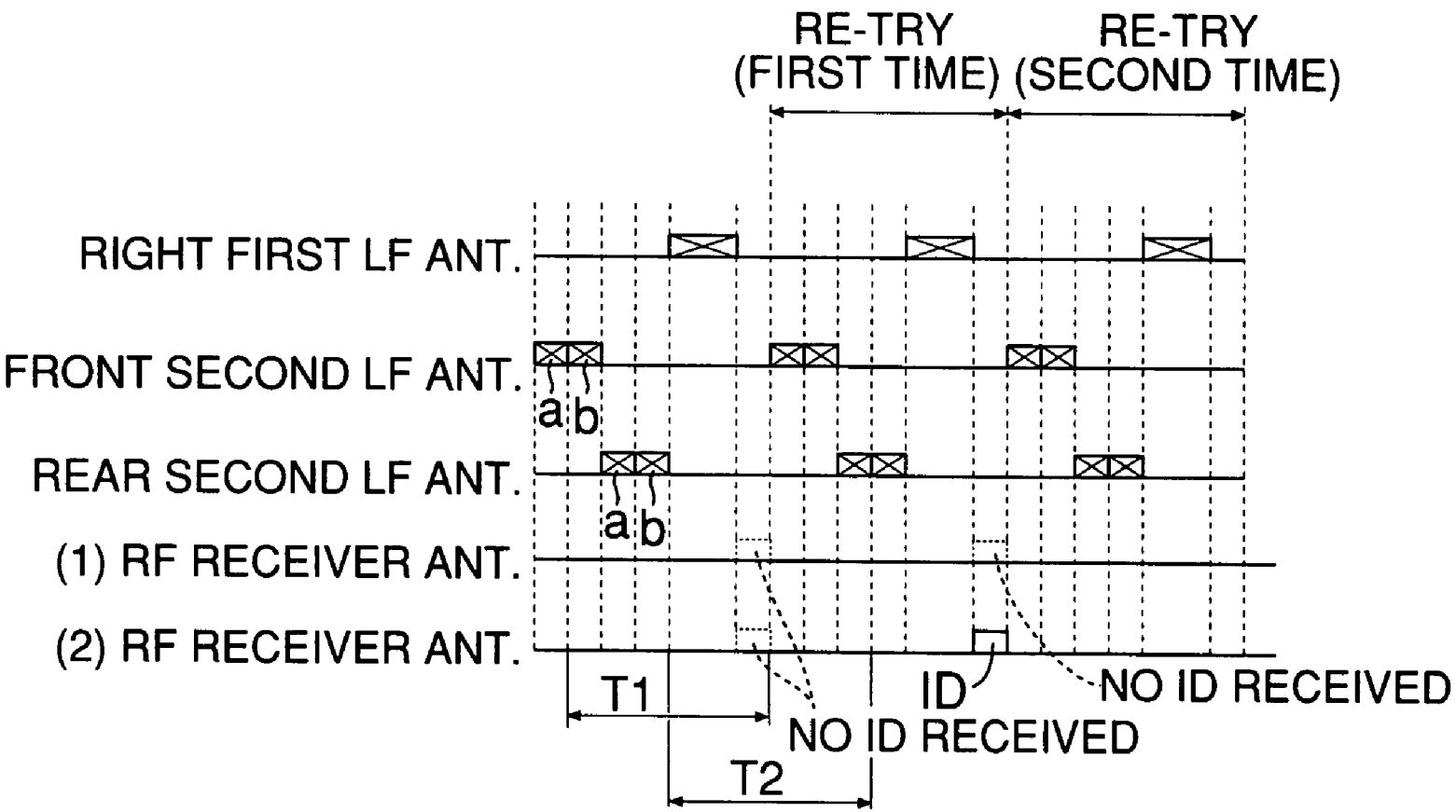
FIG. 4 is a time chart explaining the operation of the vehicular remote locking/unlocking system of FIG. 1 when a portable transceiver is present within a passenger compartment.

The reception time chart of the RF antenna 30 shown in FIG. 3 illustrates the situation where the portable transceiver 11 is located in Area A. The reception time chart (1) of the RF antenna 30 shown in FIG. 4 illustrates the situation where the portable transceiver 11 is located within any of Areas B, C, D, E, F, and G. T1 and T2 in FIG. 3 and FIG. 4 denote transmission disabled periods. The transmission disabled period T1 represents a transmission disabled period when, among two ID signal transmission disable signals $\underline{a}$ and $\underline{b}$ of the forward located second LF antenna 29*f*, the signal $\underline{a}$ is received by the portable transceiver 11, which is located in an area other than Area A. The transmission disabled period T2 represents a transmission disabled period when, among two ID signal transmission disable signals $\underline{a}$ and $\underline{b}$ of the rearward located second LF antenna 29*r*, the signal $\underline{b}$is received by the portable transceiver 11, which is located in an area other than Area A.

That is, when the portable transceiver 11 is present in Area A, the ID signal transmission disable signal is not received, as shown in the reception time chart of the RF antenna 30 of FIG. 3, so that the RF antenna 30 receives the ID signal transmitted from the portable transceiver 11 in response to reception of the ID signal request-to-send signal transmitted from the right first LF antenna 28R.

When the portable transceiver 11 is located in an area other than Area A, that is, any one of Areas B, C, D, E, F, and G, the portable transceiver 11 receives an ID signal transmission disable signal transmitted from either one of the second LF antenna 29*f* or 29*r*, so that the portable transceiver 11 is set in a transmission disabled state, at shortest, until the transmission disabled period T1 has elapsed and, at longest, until the transmission disabled period T2 has elapsed. As shown in the reception time chart (1) for the RF antenna 30 of FIG. 4, even though the portable transceiver 11 is able to receive an ID signal request-to-send signal transmitted from the right first LF antenna 29R, the portable transceiver 11 does not transmit an ID signal, and therefore the RF antenna 30 (and the RF receiver 26) cannot receive an ID signal.

The above-mentioned ID signal transmission disable signals a and b are substantially the same signals and only differ in terms of the order of transmission. Also, the transmission disabled periods T1 and T2 are the same periods of time. t1 in FIG. 3 denotes an LF signal reception disabled period of the LF receiver 13 of the portable transceiver 11 and will be described below along with the explanation of FIG. 8.

As illustrated by FIG. 4, if the portable transceiver 11 does not transmit an ID signal even though a cycle of transmitting ID signal transmission disable signals and an ID signal request-to-send signal is completed by the forward located second LF antenna 29*f*, the rearward located second LF antenna 29*r*, and the first LF antenna 28R, the cycle is retried twice.

As shown in the reception time chart (2) for the RF antenna 30 of FIG. 4, when the signal transmission ranges of the second LF antennas 29*f* and 29*r* are widened from the influence of noise, an ID signal cannot be transmitted the first time, even though the portable transceiver 11 is located outside the vehicle V. However, an ID signal can be transmitted the second time (i.e., a transmission re-try) when the influence of the noise is gone or dissipates. That is, the locking/unlocking procedure can reliably be carried out by one switching operation.

On the other hand, when noise is superimposed on the ID signal transmission disable signals transmitted by the second LF antennas 29*f* and 29*r*, the signal transmission ranges become small. Therefore, if the portable transceiver 11 is left behind on the outer periphery of the signal transmission ranges of the ID signal transmission disable signals, for example, in a pocket of the door 21L or 21R, there is the possibility that the portable transceiver 11 may not receive an ID signal transmission disable signal and erroneously transmit an ID signal.

However, in an embodiment of the present invention, when the portable transceiver 11 receives an ID signal transmission disable signal, transmission of an ID signal from the portable transceiver 11 is disabled for a predetermined period of time until transmission of a subsequent ID signal transmission disable signal is completed. Therefore, the portable transceiver 11 is prevented from erroneously transmitting an ID signal and the doors 21L and 21R from being locked/unlocked without authorization even when the portable transceiver 11 is left behind in the door pocket. Further, since each ID signal transmission disable signal is formed from two successive signals a and b (see FIG. 3), even if one of the two signals a and b is subjected to interference, such as, for example, from noise, the other signal is received by the portable transceiver 11, thereby enhancing the operation reliability of the vehicular remote locking/unlocking system. Moreover, since the portable transceiver 11 transmits an ID signal only when located outside the passenger compartment and does not transmit an ID signal when located within the passenger compartment, the power consumption of the portable transceiver 11 is substantially reduced, i.e., minimized.

As described above, even when it is confirmed that a vehicle user equipped with a legitimate portable transceiver 11 has operated the unlocking switch 23R, to make sure, it is re-determined whether the portable transceiver 11 is located within the passenger compartment, as will be described below.

As shown in FIG. 3, when the RF antenna 30 on the vehicle V side receives an ID signal transmitted by the portable transceiver 11, an ID signal transmission disable signal is transmitted from the forward located second LF antenna 29*f*, an ID signal transmission disable signal is subsequently transmitted from the rearward located second LF antenna 29*r*, and an ID signal request-to-send signal is subsequently transmitted from the first LF antenna 28R. The ID signal request-to-send signal accompanies the ID signal received from the portable transceiver 11. When the ID signal request-to-send signal accompanying the ID signal is received by the portable transceiver 11, if the ID signal matches ID information pre-stored in the portable transceiver 11, then the portable transceiver 11 transmits an ID signal. If the ID signal received by the RF antenna 30 on the vehicle V side matches ID information pre-stored on the vehicle V side, the portable transceiver 11 is authenticated and verified as being legitimate, and, as described above, a random number signal x is transmitted from the RF antenna 30 on the vehicle V side.

During the second position confirmation process of the portable transceiver 11, the position of the portable transceiver 11 is confirmed using the ID signal request-to-send signal which specifies the portable transceiver 11 having the ID signal received during the first position confirmation process. Therefore, it is possible to more reliably confirm that the vehicle user is equipped with the portable transceiver 11.

Figure 5:
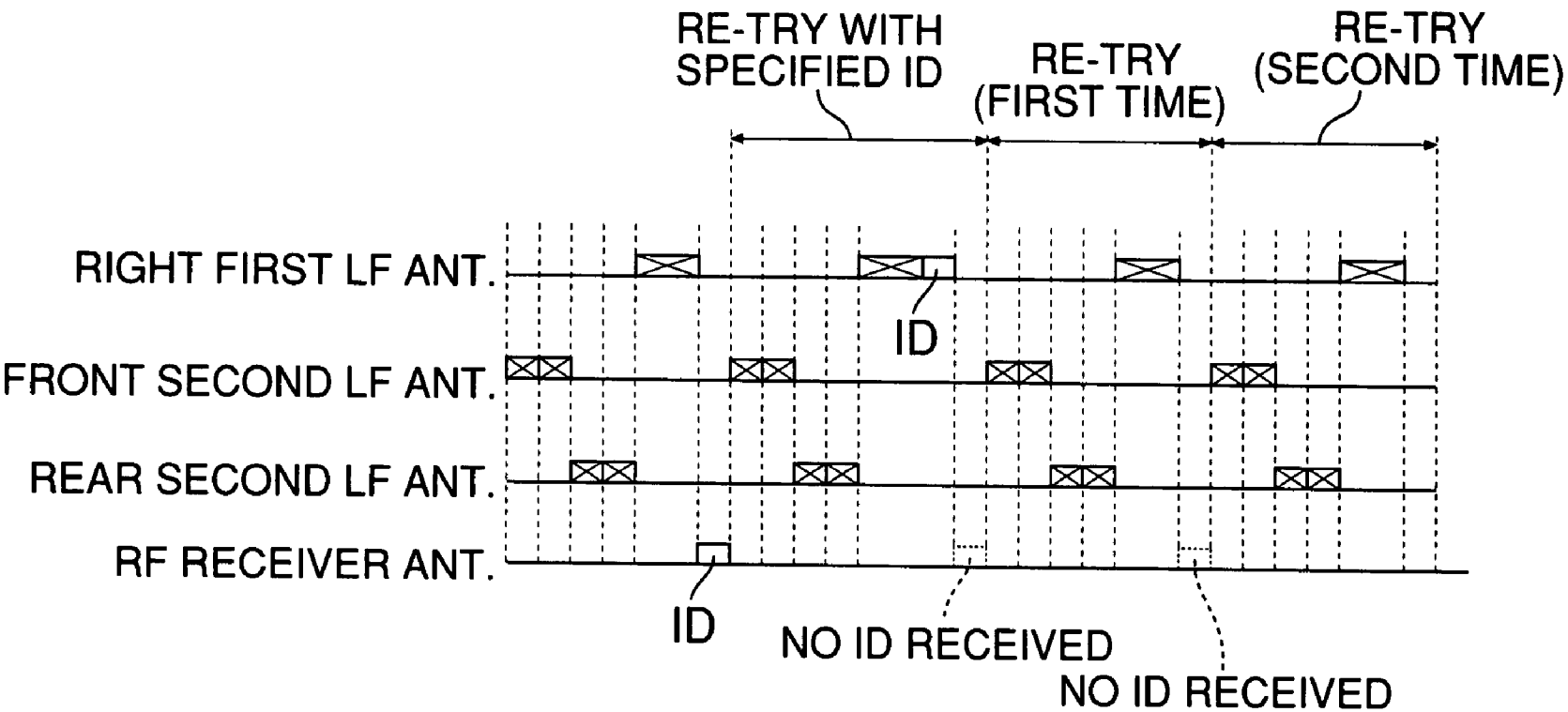
FIG. 5 is a time chart, corresponding to the time chart of FIG. 3, when an ID signal from the portable transceiver is not received again.

As shown in FIG. 5, if the ID signal request-to-send signal accompanying the ID signal is not received by the portable transceiver 11, or if it is received but the ID information does not match, the re-try explained in FIG. 4 is repeated twice.

Although a case in which the vehicle user has operated the unlocking switch 23R of the right door 21R is explained above, a similar operation is carried out in a case in which the locking switch 22R of the right door 21R is operated or in a case in which the locking switch 22L or the unlocking switch 23L of the left door 21L is operated.

In the time charts of FIG. 3 and FIG. 5 primarily, when an ID signal is received via the RF antenna 30, transmission from the forward located second RF antenna 29*f* actually starts after a bidirectional authentication period.

Figure 7:
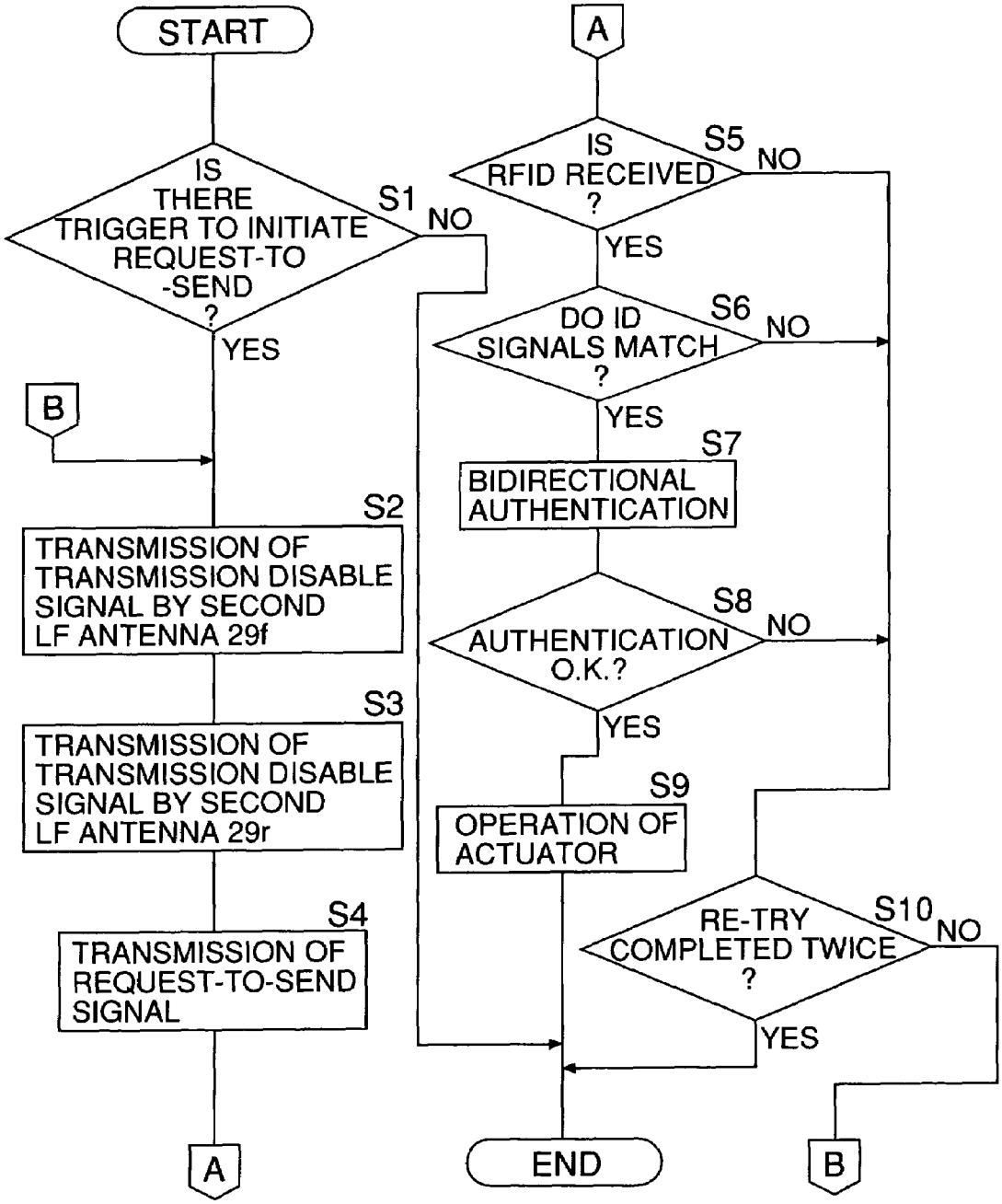
FIG. 7 is a flow chart explaining the operation of the vehicular remote locking/unlocking system of FIG. 1 on a vehicle side of the vehicular remote locking/unlocking system.

The operation of the vehicle V side of the vehicular remote locking/unlocking system is now explained by reference to FIG. 7.

In Step S1, the vehicle user presses the locking switch 22L or 22R or the unlocking switch 23L or 23R and a trigger signal is output. In Step S2, two ID signal transmission disable signals, denoted by a and b in FIG. 3, are transmitted from the forward located second LF antenna 29*f*. Next, in Step S3, two ID signal transmission disable signals are similarly transmitted from the rearward located second LF antenna 29*r*. Subsequently, in Step S4, an ID signal request-to-send signal is output from either one of the first LF antennas 28L and 28R.

If in Step S5 an ID signal is received and the ID signal is authenticated in Step S6 (i.e., if the received ID signal matches an ID signal stored in the control unit 20 on the vehicle V side), then bidirectional authentication is carried out between the vehicle V and the portable transceiver 11 in Step S7 using a random number signal x and a function signal f(x) at a radio frequency. If in Step S8 authentication is obtained (i.e., if the received function signal f(x) matches a function signal f(x) derived from the random number x in the control unit 20 on the vehicle V side), then in Step S9 the door lock actuator 27 is operated so as to lock or unlock the doors 21L and 21R (see FIG. 2).

If an ID signal is not received in Step S5, the ID signal is not authenticated in Step S6, or authentication is not obtained from the random number signal x and the function signal f(x) in Step S8, then Steps S2 to S8 are retried twice in Step S10.

Figure 8:
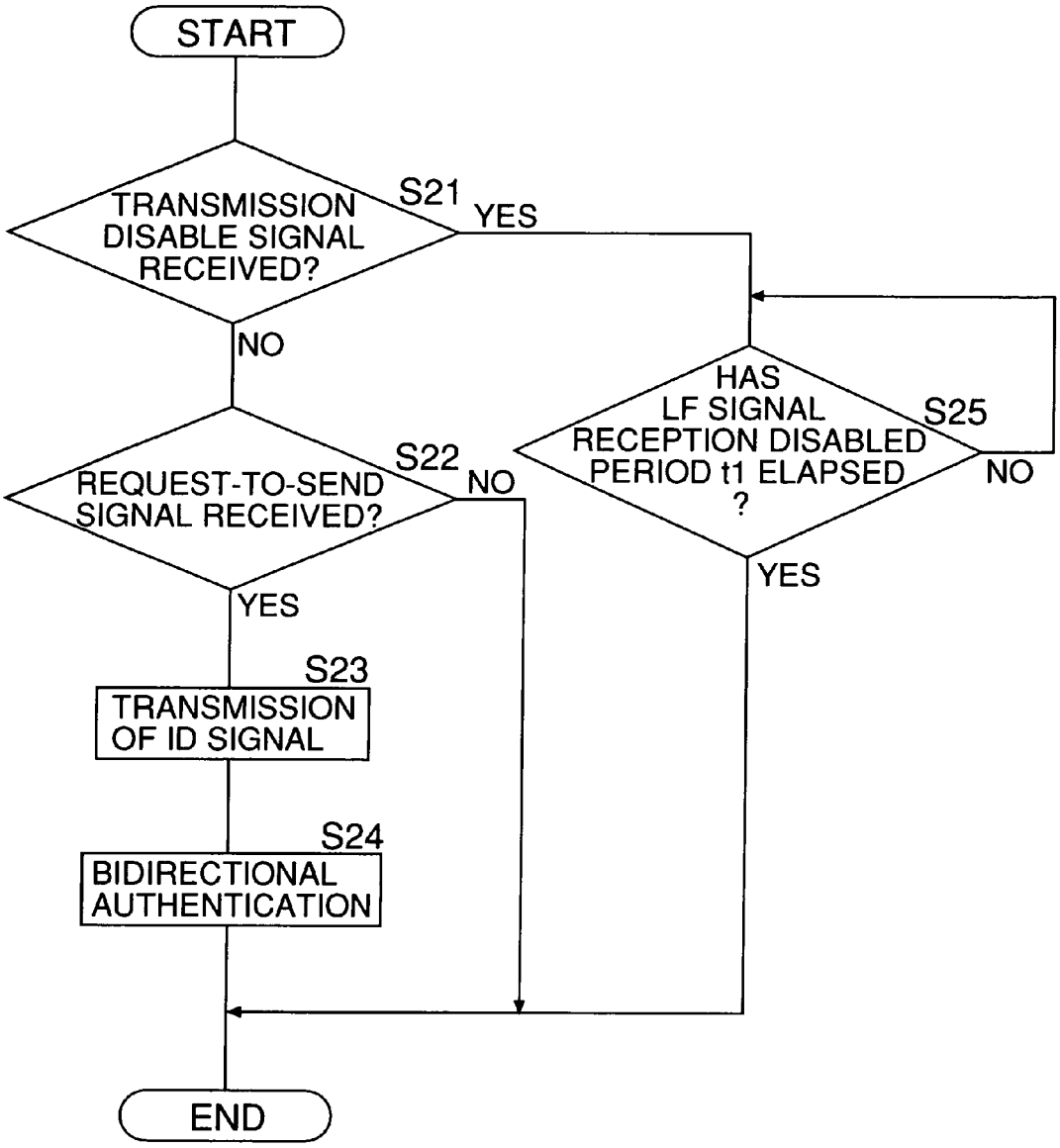
FIG. 8 is a flow chart explaining the operation of the vehicular remote locking/unlocking system of FIG. 1 on a portable device side of the vehicular remote locking/unlocking system.
Figure 9:
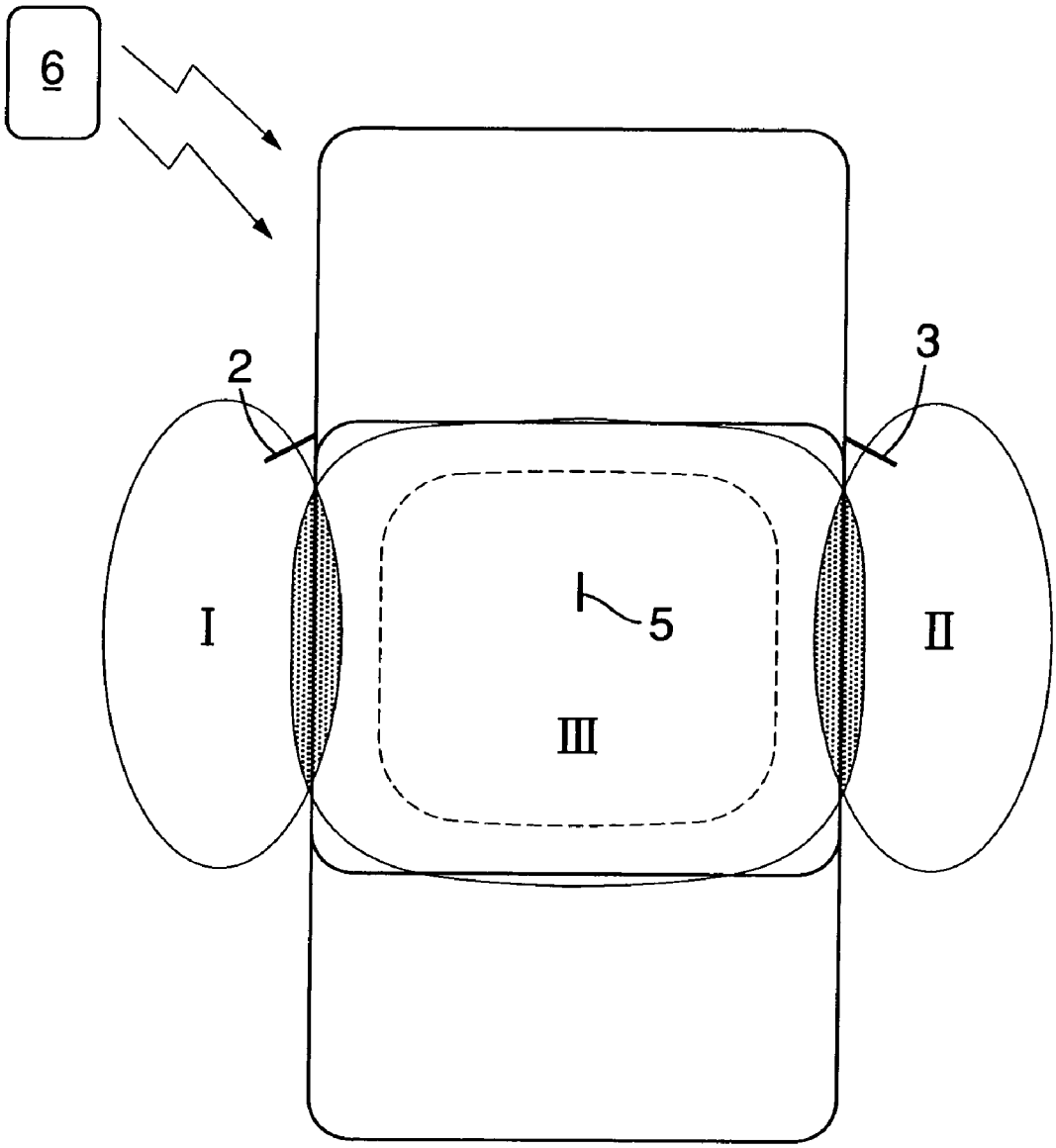
FIG.9 PRIOR ART

The operation of the portable transceiver 11 side of the vehicular remote locking/unlocking system is now explained by reference to the flow chart of FIG. 8.

If in Step S21 an ID signal transmission disable signals is not received from the second LF antennas 29*f* and 29*r*, and an ID signal request-to-send signal is received from the first LF antenna 28L or 28R in Step S22, then in Step S23 an ID signal is transmitted from the RF antenna 19 on the portable transceiver 11 side, and bidirectional authentication is carried out in Step S24. On the other hand, if in Step S21 an ID signal transmission disable signal is received from the second LF antenna 29*f* or 29*r*, then in Step S25 transmission of an ID signal from the portable device 11 is disabled for a predetermined period of time.

In the present embodiment, when the LF receiver 13 of the portable transceiver 11 receives a first ID signal transmission disable signal, the LF receiver 13 is put in a reception disabled state for a predetermined period of time, thus making reception of an ID signal request-to-send signal impossible and thereby disabling transmission of an ID signal.

The transmission disabled state in an embodiment of the present invention is explained in detail by reference to FIG. 3 and FIG. 6. When the LF receiver 13 of the portable transceiver 11 receives an ID signal transmission disable signal transmitted from the second LF antenna 29*f* or 29*r* in Step S21, the sequence stays in Step S25 until the LF signal reception disabled period t1 shown in FIG. 3 or FIG. 6 has elapsed. Accordingly, the LF receiver 13 cannot receive any ID signal request-to-send signals transmitted from the first LF antennas 28L and 28R or any ID signal transmission disable signals transmitted from the second LF antennas 29*f* and 29*r* during the period t1.

That is, when the LF receiver 13 of the portable transceiver 11 receives the ID signal transmission disable signal a transmitted from the forward located second LF antenna 29*f* in FIG. 3, it cannot receive an ID signal request-to-send signal transmitted from the right first LF antenna 28R. Therefore, the portable transceiver 11 does not transmits an ID signal, and the transmission disabled period due to reception of the ID signal transmission disable signal a becomes T1.

As shown in FIG. 3 and FIG. 6, the LF signal reception disabled period is set to be slightly longer than the period from the time when transmission of the ID signal transmission disable signal first transmitted by operating the locking switch 22L or 22R or the unlocking switch 23L or 23R is completed to the time when transmission of the ID signal request-to-send signal is completed.

Although an embodiment of the present invention is explained in detail above, the present invention can be modified in a variety of ways without departing from the spirit and scope of the present invention.

For example, in the exemplary embodiment of the present invention described above, the number of first LF antennas 28L and 28R is two and the number of second LF antennas 29*f* and 29*r* is two, however, it is within the scope of the present invention to appropriately change the number antenna. For example, four first LF antennas may be located at four corners of the vehicle V and three second LF antennas may be located at front, center, and rear positions along the center line of the vehicle V.

Furthermore, in the exemplary embodiment of the present invention described above, an ID signal transmission disable signal is transmitted twice in succession, however it is within the scope of the present invention to transmit the signal three or more times in succession.

Moreover, the opening member of the present invention is not limited to the doors 21L and 21R of the vehicle V, but may also be or include a trunk lid.

What is claimed is:

1. A vehicular remote locking/unlocking system comprising:

first transmission means provided in a vehicle, for transmitting a request signal to a predetermined area outside the vehicle, the request signal requesting transmission of identification information;

second transmission means provided in the vehicle, for transmitting a transmission disable signal to a predetermined area within the vehicle, the transmission disable signal disabling transmission of identification information for a predetermined period of time;

a portable device which transmits identification information upon receiving the request signal;

receiving means provided in the vehicle, for receiving the identification information from the portable device;

trigger means provided in the vehicle, for outputting a trigger signal initiating operation of the first and second transmission means when the trigger means is operated by a vehicle user; and locking/unlocking means for carrying out locking/unlocking of an opening member of the vehicle when the identification information received by the receiving means matches identification information stored on the vehicle side, wherein when the trigger means outputs the trigger signal, before the first transmission means transmits the request signal, the second transmission means transmits the transmission disable signal a plurality of times in succession and disables transmission of the identification information from the portable device for a predetermined period of time, and operation of the locking/unlocking means is disabled when the portable device is located within the vehicle.

2. The vehicular remote locking/unlocking system according to claim 1, wherein when the receiving means receives the identification information matching the identification information stored on the vehicle side from the portable device, after the second transmission means retransmits the transmission disable signal, the first transmission means transmits a secondary request signal containing the identification information; wherein when the portable device is not in a state in which transmission is disabled and the identification information contained in the secondary request signal received by the portable device is its own identification information, the portable device re-transmits the identification information; and wherein when the identification information received by the receiving means successively matches the identification information stored on the vehicle side, the locking/unlocking means carries out locking/unlocking of the opening member of the vehicle.

* * * * *